US005950602A

United States Patent [19]

Shinohara

[11] Patent Number: 5,950,602

[45] Date of Patent: Sep. 14, 1999

[54] FUEL SUPPLY PIPING STRUCTURE OF DIRECT-INJECTION TYPE DIESEL ENGINE

[75] Inventor: Naotoshi Shinohara, Kanagawa-ken, Japan

[73] Assignee: Nissan Motor CQ., Ltd., Kanagawa-ken, Japan

[21] Appl. No.: 08/939,127

[22] Filed: Sep. 26, 1997

[30] Foreign Application Priority Data

Sep. 27, 1996 [JP] Japan ..... 8-256332

[51] Int. Cl.[6] ..... F02M 37/04

[52] U.S. Cl. ..... 123/509; 123/469

[58] Field of Search ..... 123/469, 468, 123/507, 508, 509, 470

[56] References Cited

U.S. PATENT DOCUMENTS

| | | | |
|---|---|---|---|
| Re. 35,303 | 7/1996 | Miller | 123/508 |
| 3,402,703 | 9/1968 | Dickerson | 123/469 |
| 3,845,748 | 11/1974 | Eisenberg | 123/469 |
| 4,384,557 | 5/1983 | Johnson | 123/468 |
| 4,445,713 | 5/1984 | Bruning . | |
| 4,485,790 | 12/1984 | Nishimura et al. . | |
| 5,365,907 | 11/1994 | Dietrich et al. . | |
| 5,507,261 | 4/1996 | Johnson | 123/508 |
| 5,617,828 | 4/1997 | Kuegel | 123/468 |
| 5,775,303 | 7/1998 | Sweetland | 123/509 |

FOREIGN PATENT DOCUMENTS

| | | | |
|---|---|---|---|
| 0711915A1 | 11/1995 | European Pat. Off. . | |
| 0724075A1 | 1/1996 | European Pat. Off. . | |
| 4140668 | 7/1992 | Germany | 123/469 |
| 6147053 | 5/1994 | Japan | 123/469 |
| 1195609 | 5/1968 | United Kingdom . | |
| 1265346 | 10/1968 | United Kingdom . | |
| 2305469 | 6/1996 | United Kingdom . | |

*Primary Examiner*—Carl S. Miller
*Attorney, Agent, or Firm*—McDermott, Will & Emery

[57] ABSTRACT

The end portion of the side wall of the cylinder head where the rocker cover is attached is extended along the rocker cover, and the position of this end is set at a higher position than the position of the camshaft. The connector tube of the fuel injection nozzle is so formed that it extends obliquely downward at the upper part of the camshaft, facing onto outside from the through hole formed in the extension of the end of the side wall of the cylinder head, to be connected to the fuel supply pipe. Thereby, when the rocker cover is removed, works such as removing the fuel supply pipe from the connector tube and the like are not required, resulting the improvement of the workability. Furthermore, the capacity of the oil separator in the rocker cover can be sufficiently secured.

8 Claims, 3 Drawing Sheets

FUEL SUPPLY PIPING STRUCTURE OF DIRECT-INJECTION TYPE DIESEL ENGINE

The content of Application No. TOKUGANHEI 8-256332, filed Sep. 27, 1996, in Japan is hereby incorporated by reference.

BACKGROUND OF THE INVENTION

The present invention relates to a fuel supply piping structure in a direct-injection type diesel engine, more particularly relates to an art regarding a layout of a connector tube of a fuel injection nozzle in a cylinder head.

Conventionally, there is known a direct-injection type diesel engine of a center nozzle method, in which a cylinder head has two direct-acting induction valves and two direct-acting exhaust valves, and has four ports for induction and exhaust opened and closed by said four valves, a fuel injection nozzle being provided at a portion corresponding to a substantially central portion of said ports of said cylinder head.

In such a direct-injection type diesel engine, the fuel injection nozzle is inserted into and mounted to an insertion hole disposed in the cylinder head, and fixed to said cylinder head by a nozzle-holding arm arranged on the upper portion of the cylinder head.

To a nozzle holder constituting a body of the fuel injection nozzle is integrally formed a connector tube which is arranged extending from a side of said nozzle holder along the side thereof to guide fuel from a fuel supply pipe guided from a fuel supply source to the fuel injection nozzle. This connector tube is facing onto outside from a through hole formed on the wall of the engine body and connected to said fuel supply pipe.

SUMMARY OF THE INVENTION

Conventionally, when the valve-driving method in the direct-injection type diesel engine is an indirect-acting method using a rocker arm, the connector tube can be arranged under a camshaft. Therefore, the connector tube is projected abeam or horizontally from the fuel injection nozzle so as to face onto outside from a through hole formed on the side wall of the cylinder head (see Japanese Laid-Open Utility Model Publication No. 60-57775).

However, in the case of a direct-acting method using a lifter, the connector tube is arranged at a higher position than the camshaft, therefore the connector tube cannot be projected abeam or horizontally from the fuel injection nozzle. Namely, since there is a lifter housing for attaching a lifter at a lower part of the camshaft, this lifter housing hinders the connector tube from projecting abeam or horizontally, and the connector tube cannot be formed to face onto outside from the through hole on the side wall of the cylinder head.

Therefore, the conventional method used in the direct-acting structure is to make a connector tube face onto outside from a through hole on the side wall of a rocker cover coupled to the upper part of the cylinder head.

Concretely, a through hole is formed at a lower end of a side wall of a rocker cover, a tubular rubber seal is press-fitted to this through hole, and one end of this rubber seal is press-fitted to the tip of the connector tube of the fuel injection nozzle. And, the tip of the connector tube is connected to a fuel supply pipe inside of the rubber seal.

In such a structure, however, when the rocker cover is removed, it is required to detach the fuel supply pipe from the connector tube and to remove the rubber seal from the connector tube, which makes the workability poor.

Furthermore, when the rubber seal is removed, it is easily deformed, thereby it must be replaced. Thus, there is a problem that it is not advantageous from the viewpoint of cost.

On the other hand, there is a method to connect the connector tube to the fuel supply pipe by arranging a rubber plug on the face where the cylinder head and the rocker cover are put together, and guiding the connector tube outside from the rubber plug (see Japanese Laid-Open Patent Publication No. 6-173817). In this method, however, there is such a problem that oil leaks between the rubber plug and the cylinder head, which is not desirable.

Furthermore, in a method that the connector tube is directed toward outside from the through hole on the side wall of the rocker cover and a method that the connector tube is guided outside from the rubber plug on the face where the cylinder head and the rocker cover are put together, as described above, it is necessary to secure a space through which the connector tube extends on the side of the rocker cover. To secure this space, the rocker cover cannot be made large due to the restriction in the layout, resulting a problem that the capacity of an oil separator in the rocker cover is not sufficient.

The present invention has been completed under such a background. The object of the present invention, therefore, is to provide a fuel supply piping structure in a direct-injection type diesel engine in which bothersome works such as removal of a fuel supply pipe from a connector tube is not required when a rocker cover is removed, and the capacity of an oil separator in the rocker cover can be sufficiently secured.

The present invention is a fuel supply piping structure used in a direct-injection type diesel engine, comprising a cylinder head including four ports opened and closed, respectively, by two direct-acting induction valves and two direct-acting exhaust valves, a fuel injection nozzle arranged between four ports of the cylinder head, and a connector tube having one end connected to the fuel injection nozzle and the other end connected to a fuel piping system. A through hole communicating the inside and outside of the cylinder head is provided on the side wall of the cylinder head, and the other end of the connector tube is inserted into the through hole and connected to the fuel piping system.

In the case of a direct-injection type diesel engine in which four ports are disposed in one end of the cylinder head, a rocker cover is attached at the other end of the cylinder head, and a camshaft is arranged between the four valves in the cylinder head and the other end of the cylinder head, the side walls may be extended from one end of the cylinder head to the other end thereof so that the ends of the side walls are located at a position nearer to the other end of the cylinder head than the camshaft to be brought into contact with a rocker arm, the connector tube may be arranged nearer to the other side of the cylinder head than the camshaft, and the through hole may be inclined toward the other end of the cylinder head from outside of the cylinder head to inside thereof.

As a fuel piping system, a fuel supply pipe may be provided, and the other end of the connector tube may be connected to the fuel supply pipe inside of the through hole.

In the above structure, the connector tube can be formed to face onto outside from the side wall of the cylinder head, and the rocker cover can be removed without hindering the fuel piping system of the fuel injection nozzle. Therefore, when the rocker cover is removed, such works as removal of the fuel supply pipe from the connector tube and the like are not required, whereby the workability can be improved.

The structure may be such that the connection portion of the other end of the connector tube and the fuel supply pipe is covered with a tubular sealing member, the tubular sealing member being attached to the tip of the other end of the connector tube in a pressed state and press-fitted into the through hole.

In the above structure, even if voids or the like are caused between the fuel supply pipe and the connector tube, the tubular sealing member can prevent the fuel from leaking into the cylinder head. Therefore, the fuel sealability between the fuel piping system and inside the cylinder head can be improved.

The tubular sealing member may be made of rubber.

In the above structure, the tubular sealing member can be easily formed, as well as the sealability can be easily improved.

Said end of the side walls may be set at a height that allows rotation of a jig which is inserted from an opening face on the other end of the cylinder head into the cylinder head to rotate the camshaft at the time of adjusting clearance of the valve.

In the above structure, the work to adjust clearance of the valve after the rocker cover is removed can be performed without any obstruction.

When the rocker cover has a separator to separate the oil in the blow-bye gas led into the rocker cover therein, the connector tube may be extended between the separator and the camshaft. In such a structure, the connector tube can be arranged by effectively using a space between the separator and the camshaft to improve the layout of the connector tube.

The separator may be formed so that the capacity is increased toward inside of the cylinder head.

The capacity of the separator can be increased without changing the position of the upper end of the rocker cover which has restrictions in its form and layout.

The fuel supply pipe may be connected to the connector tube via a pipe joint of a screw-fitting type.

In the above structure, the connection between the fuel supply pipe and the connector tube can be easily and securely performed, thus the connection workability therebetween is improved.

DESCRIPTION OF THE PREFERRED EMBODIMENTS

Embodiments of the present invention will now be described with reference to the accompanying drawings.

Figure 1:
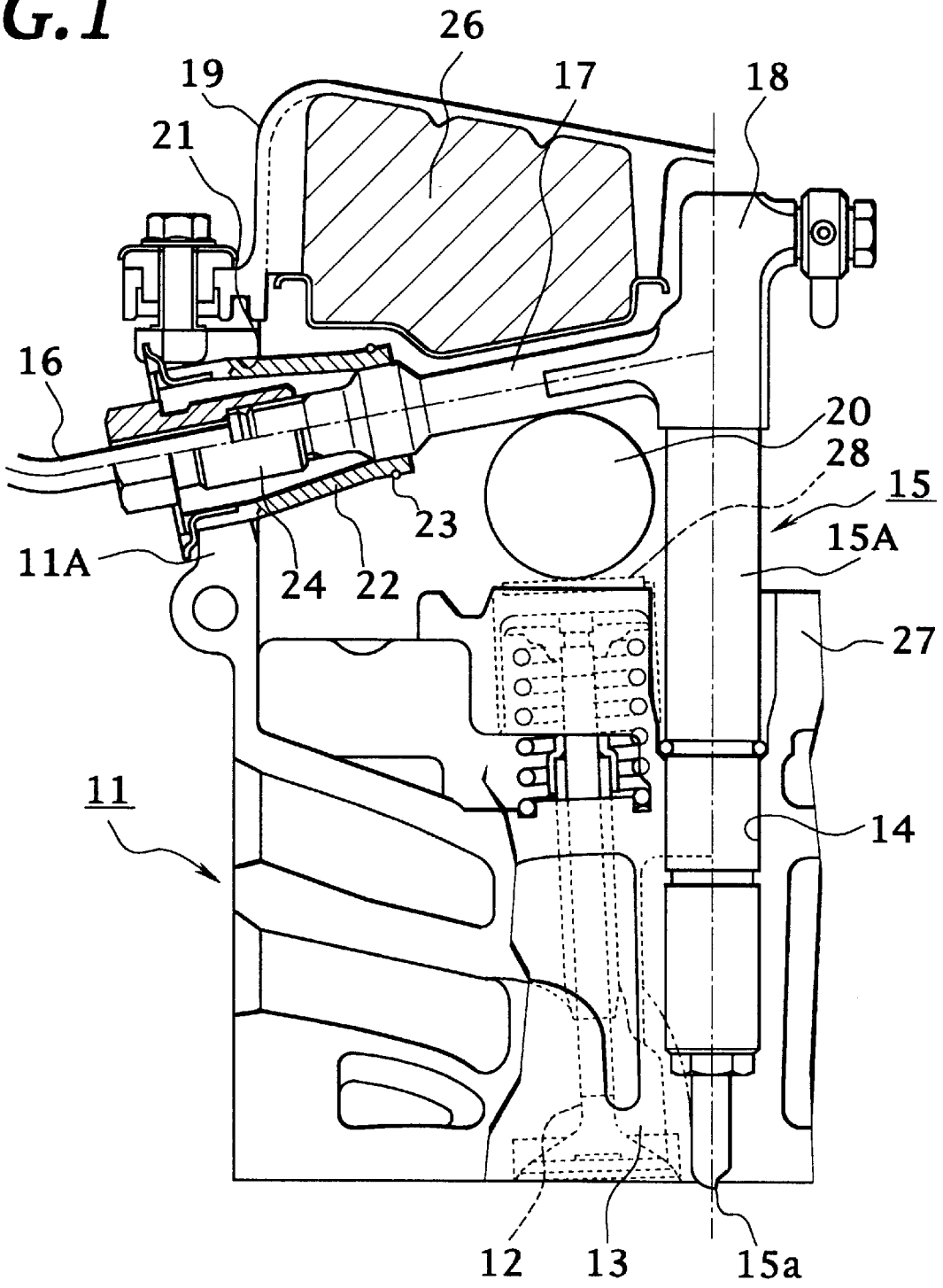
FIG. 1 is a longitudinally sectional view showing one embodiment of the fuel supply piping structure in the direct-injection type diesel engine according to the present invention.
Figure 2:
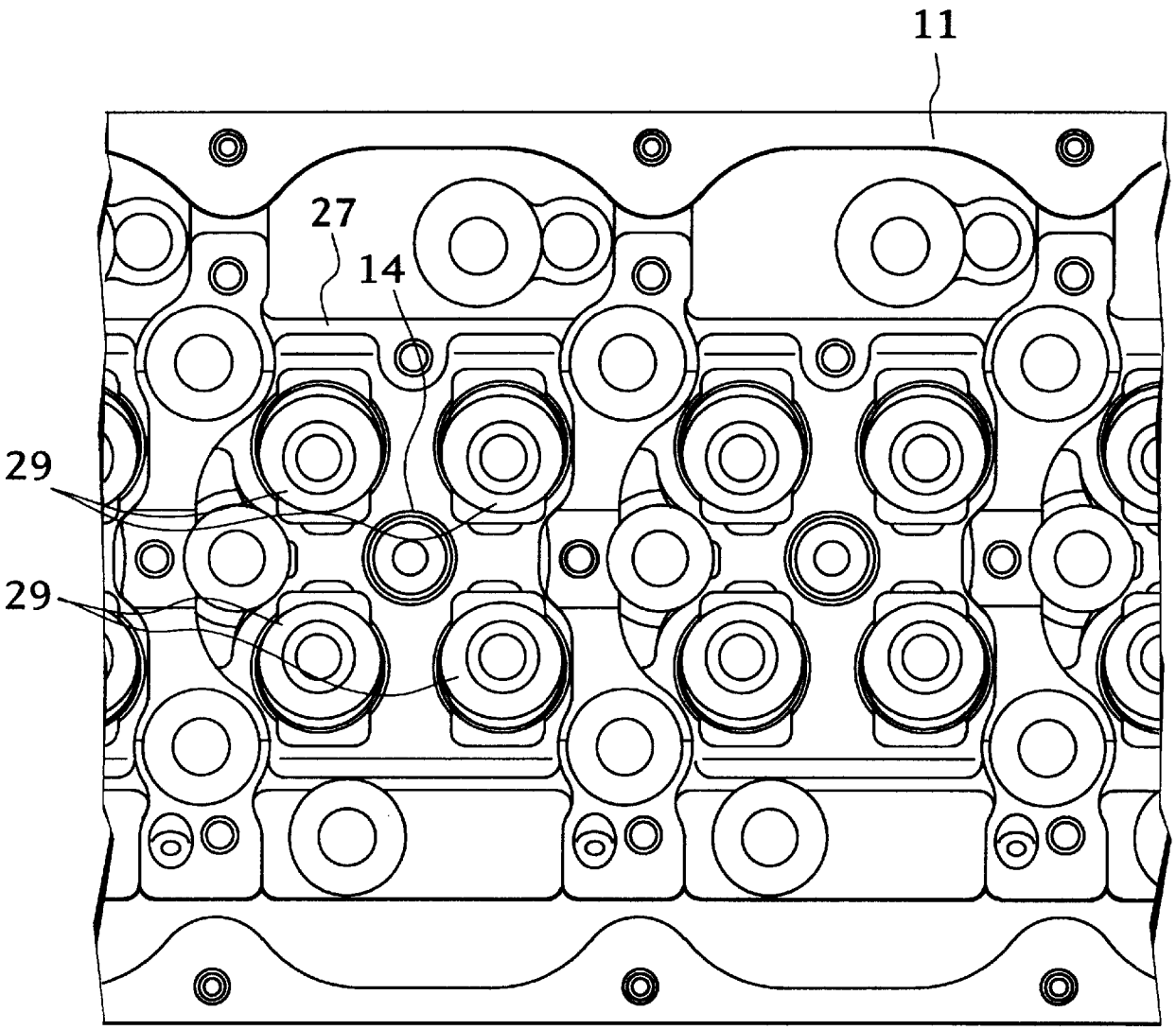
FIG. 2 is a plan view of the cylinder head shown in FIG. 1.

As shown in FIGS. 1 and 2, a cylinder head 11 of a direct-injection type diesel engine in an overhead cam (OHC) method is provided with two direct-acting induction valves and two direct-acting exhaust valves (not shown), and four ports 13 opened and closed by said four valves are formed in said cylinder head 11. The four ports 13 are disposed in one end (lower end in FIG. 1) of the cylinder head 11.

A fuel injection nozzle 15 is inserted into and attached to an insertion hole 14 provided in a portion corresponding to substantially central portion of the four ports 13 of the cylinder head 11 (center nozzle method).

In a direct-injection type diesel engine having such a structure, the fuel injection nozzle 15 is fixed to said cylinder head 11 by a nozzle-holding arm (not shown) provided on the upper part of the cylinder head 11.

A connector tube 17 leading the fuel from a fuel supply pipe 16 which is led from the fuel supply source to the fuel injection nozzle 15 is integrally formed on the side of an end portion opposite to an end where an apical injection hole 15*a* of a nozzle holder 15A constituting a body of said fuel injection nozzle 15 is formed. A fuel-back pipe 18 constituting a back passage for excess fuel is integrally formed at said end portion of the nozzle holder 15A.

The end portion on a side wall of the cylinder head 11 where a rocker cover 19 is attached is extended to the rocker cover 19 side (the other end of the cylinder head 11) (extension 11A), and said end position is set at a higher position than a camshaft 20 (at a position on the other end of the cylinder head 11).

The connector tube 17 of the fuel injection nozzle 15 is so formed as to extend obliquely downward with a predetermined angle from the side of the nozzle holder 15A through the upper part of the camshaft 20 toward the extension 11A. The connector tube 17 is inserted into a through hole 21 formed in the extension 11A of the end portion on the side wall of the cylinder head 11 where the rocker cover 19 is attached, and connected to the fuel supply pipe 16, facing onto outside of the cylinder head 11 from the through hole 21.

More specifically, the connector tube 17 is so arranged that its tip portion is located in a position in the vicinity of the inner opening face of the through hole 21 of the cylinder head 11.

The through hole 21 of said cylinder head 11 is formed in a circular form, designating a line extended from the center line of the inclined connector tube 17 as a center, and in a form obliquely upward with a predetermined angle against to the vertical from outside of the cylinder head 11 to inside thereof.

A rubber seal 22 is press-fitted as a tubular sealing member covering a connection of the connector tube 17 and the fuel supply pipe 16. This rubber seal 22 is fixed in a state that it is inclined upward from outside of the cylinder head 11 to inside thereof along the through hole 21.

One end of the rubber seal 22 is press-fixed to the through hole 21, and the other end thereof is extended toward inside of the cylinder head 11 and coupled to a large-diameter section of the connector tube 17 at a predetermined length from the apical face thereof with a ring 23.

The fuel supply pipe 16 is connected to the connector tube 17 via a pipe joint 24 of a screw-fitting type inside of the rubber seal 22.

Figure 3:
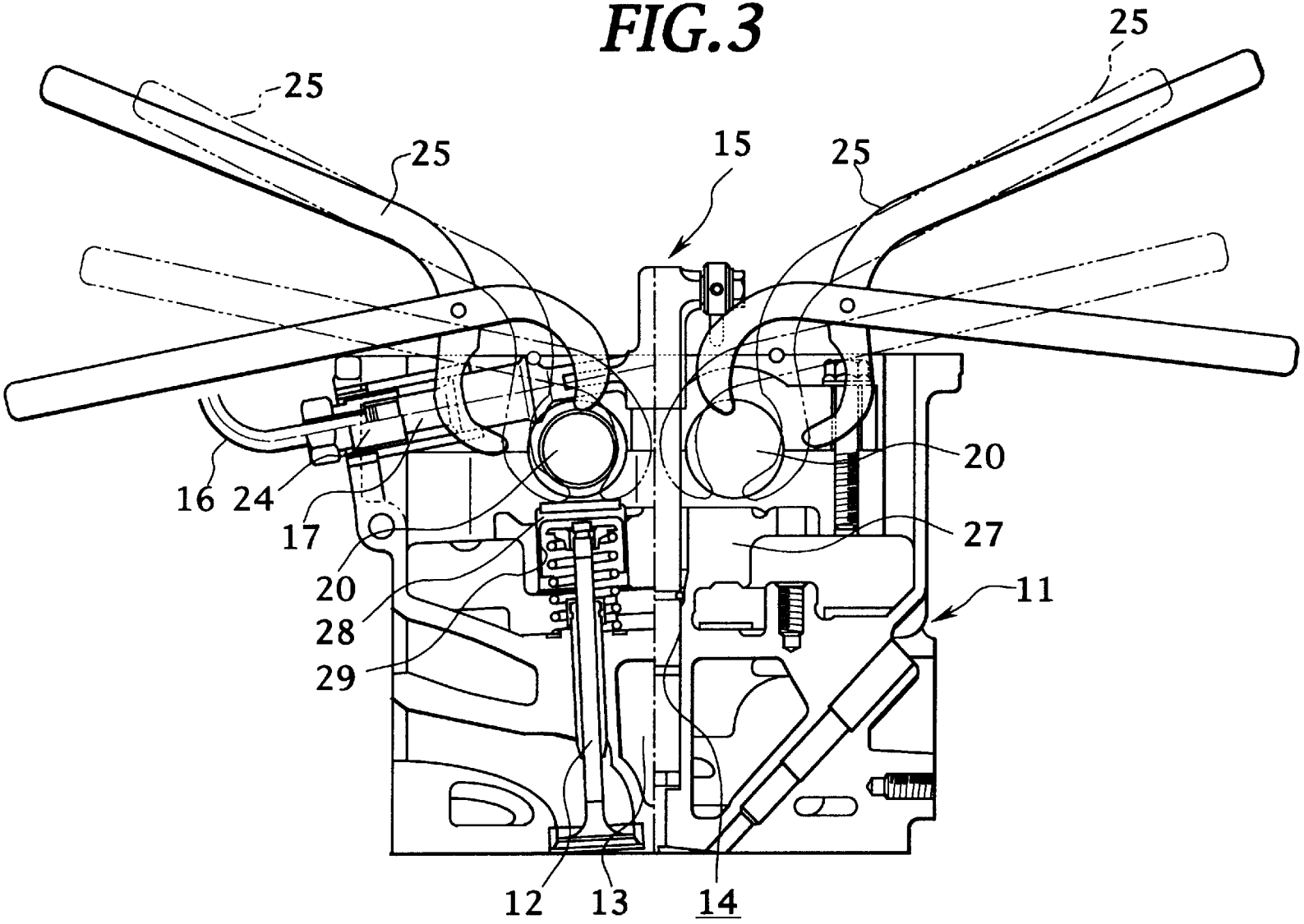
FIG. 3 is a longitudinally sectional view showing a rotational trajectory of a pliers.

Now will be described how to set the end position where the rocker cover 19 is attached on the side wall of the cylinder head 11. Said end position is set at a height which allows rotation of a jig for rotating the camshaft 20, for example, a pliers 25 shown in FIG. 3, which is inserted into the inside of the cylinder head 11 from the open face on the upper part of the cylinder head 11, at the time of adjusting the tappet clearance of the induction valve 12 or the exhaust valve. Two-dots line in FIG. 3 shows the limit of rotation of the pliers 25, and it can be seen that the pliers 25 can rotate up to the position of the two-dots line in the drawing.

On the other hand, an oil separator 26 is built in inside of the rocker cover 19, and the connector tube 17 is extended between this oil separator 26 and the camshaft 20.

The bottom part of the oil separator 26 is formed at a position in the vicinity of the connector tube 17. The oil separator 26 is so formed that the cross section thereof is gradually increased toward inside of the cylinder head 11 so as to increase the capacity of the oil separator 26 gradually toward inside of the cylinder head 11.

In addition, a lifter hole 29 is formed in a housing 27 so that a lifter 28 for activating the cam of the camshaft 20 is slidably supported.

According to the structure described above, actions/effects of (1) to (7) described below can be obtained:

(1) Since the end portion where the rocker cover 19 is attached on the side wall of the cylinder head 11 is extended along the rocker cover 19 to set said end position at a higher position than the camshaft 20, the connector tube 17 of the fuel injection nozzle 15 is so formed as to extend obliquely downward at the upper part of the camshaft 20, facing onto outside from the through hole 21 formed in the extension 11A at the end of the side wall of the cylinder head 11, and connected to the fuel supply pipe 16, the connector tube 17 can be faced outside from the side wall of the cylinder head 11.

As a result, the rocker cover 19 can be removed without hindering the fuel piping system of the fuel injection nozzle 15. That is, when the rocker cover 19 is removed, it is not required to remove the fuel supply pipe 16 from the connector tube 17 and remove the rubber seal 22 from this connector tube 17.

Furthermore, as a result that removal of the rubber seal 22 is not required, no problem is caused relating to deformation of the rubber seal 22, and replacement of the rubber seal 22 is not necessary.

(2) Since the rubber seal 22 which is coupled to the tip portion of the connector tube 17 to cover the connection of said connector tube 17 and the fuel supply pipe 16 is press-fixed to the through hole 21, even if the fuel leaks from the connection of the fuel supply pipe 16 and the connector tube 17, the fuel will not reach inside of the cylinder head 11, thus the fuel seal can be securely performed.

(3) Since the end position on the side wall of the cylinder head 11 where the rocker cover 19 is attached is set at a height that allows rotation of a jig, such as a pliers 25 which is inserted into the cylinder head 11 from the open face at the upper end of the cylinder head 11 and rotates the camshaft 20, at the time of adjusting the tappet clearance of the induction valve 12 or the exhaust valve, adjustment of the tappet clearance can be performed without hindering rotation of a jig such as a pliers 25.

(4) Since the connector tube 17 is extended between the oil separator 26 and the camshaft 20, layout of the connector tube 17 can be performed, using the space between the oil separator 26 and the camshaft 20 effectively.

(5) As a result of forming the connector tube 17 so as to extend obliquely downward at the upper part of the camshaft 20, the capacity of the oil separator 26 can be enlarged toward the inside of the cylinder head 11 without changing the upper end position of the rocker cover 19, and the oil amount brought out by the blow-bye gas can be reduced by enlarging the capacity of the oil separator 26.

(6) Since the fuel supply pipe 16 is connected to the connector tube 17 via a pipe joint 24 of a screw-fitting type, the connection between the fuel supply pipe 16 and the connector tube 17 can be easily and securely performed.

(7) A rubber seal 22 is applied as a sealing member, therefore it can be easily formed and the sealability can be improved.

What is claimed is:

1. A fuel supply piping structure of a direct-injection type diesel engine using a center nozzle method, comprising:

a cylinder head including four ports opened and closed, respectively, by two direct-acting induction valves and two direct-acting exhaust valves, said four ports being disposed in one end of the cylinder head;

a fuel injection nozzle arranged between four ports of the cylinder head;

a connector tube having one end connected to the fuel injection nozzle and the other end connected to a fuel piping system;

a rocker cover attached to the other end of the cylinder head; and camshafts arranged over said four valves in the cylinder head, and provided with cams for driving said four valves, said cylinder head including a side wall extending upwards beyond one of the camshafts, the end portion of said side wall being in contact with said rocker cover, said connector tube being arranged between said camshaft and said rocker cover;

said side wall having a through hole communicating an inside and an outside of the cylinder head, and inclining toward the other end of the cylinder head from outside of the cylinder head to inside thereof, and the other end of said connector tube being inserted into the through hole and connected to the fuel piping system.

2. The fuel supply piping structure of a direct-injection type diesel engine according to claim 1, wherein said fuel piping system is a fuel supply pipe, and said other end of the connector tube and said fuel supply pipe are connected within the through hole.

3. The fuel supply piping structure of a direct-injection type diesel engine according to claim 2, wherein the connection of said other end of the connector tube and said fuel supply pipe is covered with a tubular sealing member, and said tubular sealing member is attached to the tip of said other end of the connector tube in a pressed state, and press-fitted into said through hole.

4. The fuel supply piping structure of a direct-injection type diesel engine according to claim 3, wherein said tubular sealing member is made of rubber.

5. The fuel supply piping structure of a direct-injection type diesel engine according to claim 1, wherein said end portion of the side wall is set at a height so as to allow rotation of a jig which is inserted into the cylinder head from an open face on the other end of the cylinder head and rotates the camshaft, at the time of adjusting clearance of said valve.

6. The fuel supply piping structure of a direct-injection type diesel engine according to claim 1, wherein said rocker cover has a separator for separating the oil in the blow-bye gas led into the rocker cover therein, and said connector tube is extended between the separator and the camshaft.

7. The fuel supply piping structure of a direct-injection type diesel engine according to claim 6, wherein said separator is so formed that the capacity thereof is increased toward the inside of the cylinder head.

8. The fuel supply piping structure of a direct-injection type diesel engine according to claim 2, wherein said fuel supply pipe is connected to the connector tube via a pipe joint of a screw-fitting type.

* * * * *